US007082273B2

(12) United States Patent
Matsunai

(10) Patent No.: US 7,082,273 B2
(45) Date of Patent: Jul. 25, 2006

(54) IMAGE FORMING APPARATUS WITH ELECTRICITY ELIMINATING MEMBER

(75) Inventor: Tomohiro Matsunai, Kawasaki (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 1048 days.

(21) Appl. No.: 10/032,615

(22) Filed: Jan. 2, 2002

(65) Prior Publication Data

US 2003/0123095 A1 Jul. 3, 2003

(51) Int. Cl.
*G03G 15/00* (2006.01)
*G03G 15/20* (2006.01)

(52) U.S. Cl. ..... 399/90; 219/216; 399/328; 399/330

(58) Field of Classification Search ..... 399/328, 399/330, 333, 320, 90
See application file for complete search history.

(56) References Cited

U.S. PATENT DOCUMENTS 5,045,891 A * 9/1991 Senba et al. ..... 219/216 X
6,014,539 A * 1/2000 Sano et al. ..... 219/216 X
6,137,087 A * 10/2000 Tomatsu ..... 219/216
6,269,230 B1 * 7/2001 Kiuchi ..... 399/330 X
6,285,006 B1 * 9/2001 Hyllberg ..... 219/216
6,463,251 B1 * 10/2002 Kiuchi ..... 399/330

FOREIGN PATENT DOCUMENTS

JP 01-204084 A * 8/1989
JP 02-105190 A * 4/1990
JP 05-040426 A * 2/1993
JP 6-102783 4/1994
JP 11-074068 A * 3/1999
JP 11-282300 10/1999
JP 2000-200008 A * 7/2000

* cited by examiner

*Primary Examiner*—Sophia S. Chen
(74) *Attorney, Agent, or Firm*—Foley & Lardner LLP

(57) ABSTRACT

An image forming apparatus according to the present invention includes: a pressing roller for pressing a sheet of paper on which an unfixed developer is prepared; a fixing roller including a conductive roller and a releasing layer coating the conductive roller, the releasing layer facilitating removal of adhered developer, the fixing roller rotating with the sheet of paper being sandwiched between the fixing roller and the pressing roller to fix the developer to the sheet of paper with heat; an auxiliary member being for eliminating electricity a substantial circle member, engaged with the outer surface of said fixing roller, and having at least one protruding portion penetrating the releasing layer to contact and electrically connect to the surface of the conductive roller; and an member set at ground potential for electrically contact the auxiliary member to the ground potential.

16 Claims, 5 Drawing Sheets

IMAGE FORMING APPARATUS WITH ELECTRICITY ELIMINATING MEMBER

FIELD OF THE INVENTION

The present invention relates to an image forming apparatus including a fixing device of induction heating type.

BACKGROUND OF THE INVENTION

As a fixing device for an image forming apparatus, there is a fixing device of induction heating type, whose heating roller contains an induction heating coil therein. Such a heating roller has a conductive roller of iron, and except for the edge portions, the outer surface of such a heating roller is coated with a releasing layer of a fluorine containing resin, such as Teflon (brand name), so as to prevent the adhesion of toner. The grounding of the heating roller has been performed as follows: the conductive roller is exposed at one edge of the heating roller so that a brush mounted on a grounded metal frame is allowed to contact the surface of the exposed edge of the conductive roller.

However, if the entire outer surface of the conductive roller is covered with a releasing layer, it is not possible to cause a sufficient antistatic effect on the conductive roller because the brush for eliminating electricity contacts the conductive roller via the releasing layer. In such a state, the conductive roller serves as an antenna for the induction heating coil, so that electric wave noises from the induction heating coil are emitted from the conductive roller.

SUMMARY OF THE INVENTION

An object of the present invention is to provide an image forming apparatus including a fixing device of induction heating type, which is capable of solving the above-described problem, and which is capable of surely grounding a conductive roller in a heating roller.

An image forming apparatus according to the present invention includes: a pressing roller for pressing a sheet of paper on which an unfixed developer is prepared; a fixing roller including a conductive roller and a releasing layer coating the conductive roller, the releasing layer facilitating removal of adhered developer, the fixing roller rotating with the sheet of paper being sandwiched between the fixing roller and the pressing roller to fix the developer to the sheet of paper with heat; an auxiliary member for eliminating static electricity being a substantial circle member, engaged with the outer surface of said fixing roller, and having at least one protruding portion penetrating the releasing layer to contact and electrically connect to the surface of the conductive roller; and an member set at ground potential for electrically contact the auxiliary member to ground the potential.

DESCRIPTION OF THE PREFERRED EMBODIMENTS

Hereinafter, embodiments of the present invention will be described with reference to the drawings.

Figure 1:
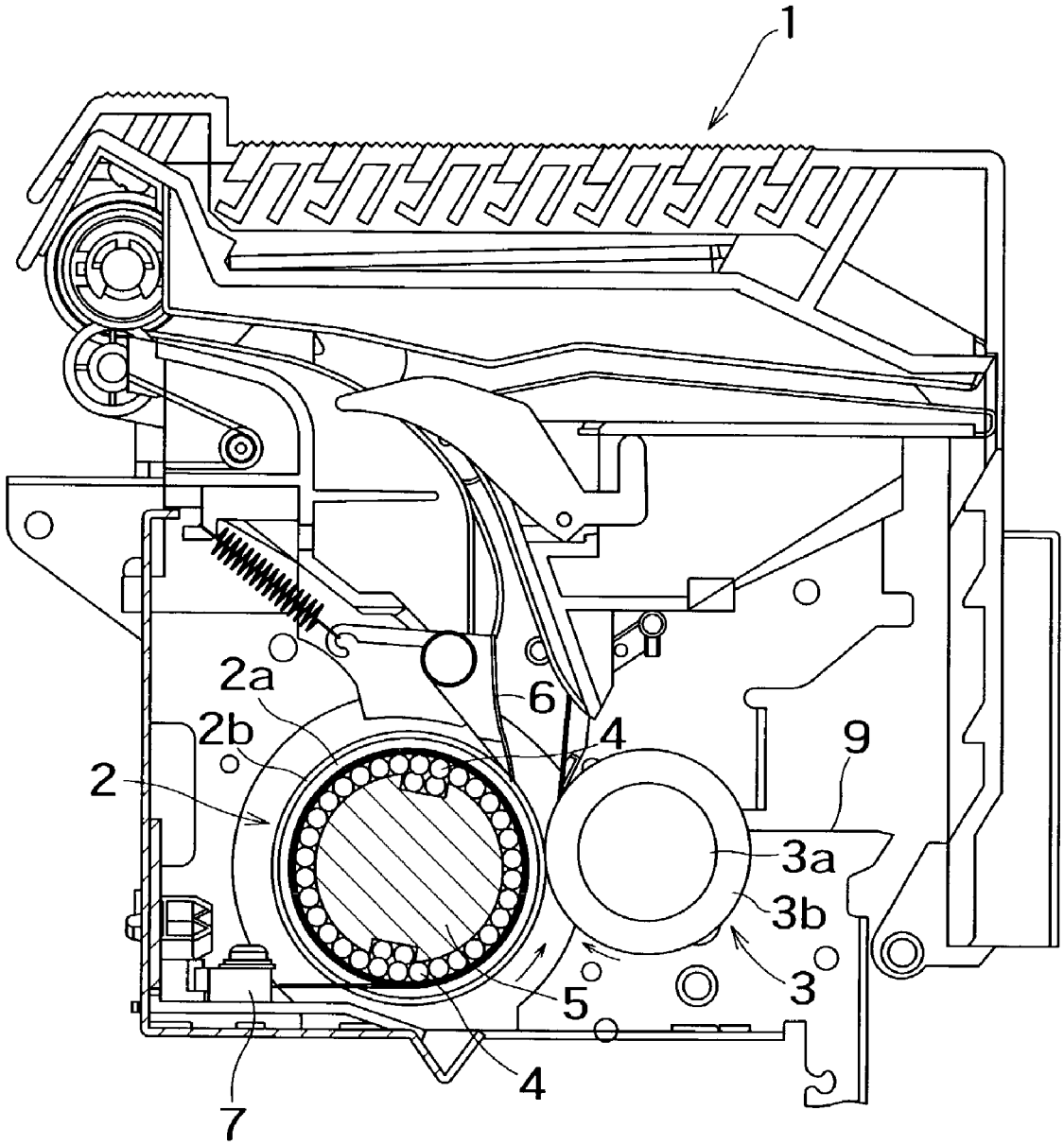
FIG. 1 is a schematic sectional view of the entire structure of an induction heating fixing device according to an embodiment of the present invention.

FIG. 1 is a schematic sectional view showing the entire structure of an induction heating fixing device according to an embodiment of the present invention.

An induction heating fixing device 1 of this embodiment includes a heating roller (fixing roller) 2 and a pressing roller (pressure roller) 3. A sheet is sandwiched between them to be fed, thereby fixing a developer having been prepared on the sheet, such as a toner, to the sheet using heat and pressure.

In more detail, the induction heating fixing device 1 includes a heating roller 2 (60 mm) and a pressing roller 3 (60 mm). The pressing roller 3 is pressed against the heating roller 2 by a pressing mechanism (not shown) so as to maintain a constant nip width between the pressing roller 3 and the heating roller 2. The heating roller 2 is rotated by a driving motor (not shown) in the direction of the arrow in the figure. Following the rotations of the heating roller 2, the pressing roller 3 rotates in the direction of the arrow in the figure.

The heating roller 2 is formed by coating the outer surface of a conductive roller 2*a* with a releasing layer (adhesion preventing layer) 2*b* of Teflon (brand name), etc. The wall thickness of the conductive roller 2*a* is generally between about 0.5 mm to about 3.0 mm. In this embodiment, the wall thickness is 1.5 mm. Although iron is used as a material of the conductive roller 2*a* in this embodiment, other materials such as stainless steel, aluminum, composite materials formed of stainless steel and aluminum, etc., may be used. The pressing roller 3 is formed by coating the outer surface of a core member 3*a* with an insulating material 3*b* such as silicon rubber, fluorine rubber, etc.

A magnetic field generating means (induction heating coil) 4 is provided inside the heating roller 2. The induction heating coil 4 is a Litz wire formed by braiding a plurality of copper wires each having a diameter of 0.5 mm, which are insulated from each other by coating. The induction heating coil 4 is wound around a core 5 in a longitudinal direction. In this embodiment, a Litz wire obtained by braiding 19 copper wires each having a diameter of 0.5 mm is used according to 100 V specification. As a material for coating the induction heating coil 4, polyimide, which is heat-resistant, is used. The heating principle for heating the heating roller 2 by the induction heating coil 4 is as follows. That is, a high-frequency current is supplied from an excitation circuit, not shown, to the induction heating coil to generate an alternating flux, resulting in that an eddy current, which hinders changes in magnetic field, is generated in the conductive roller 2*a*. Due to the eddy current and the resistance caused by the conductive roller 2*a*, Joule heat is generated in the conductive roller 2*a*, which heats up the conductive roller 2*a*.

A removing plate or sheet 6 for removing transfer paper from the heating roller 2 and a thermistor 7 for detecting the surface temperature of the heating roller 2 are arranged in this order in the downstream area of the rotating direction of the heating roller 2, when viewed from the contact position (nip portion) of the heating roller 2 and the pressing roller 3. The induction heating fixing device 1 is configured such that the surface temperature of the heating roller 2 is maintained at a predetermined value by the feedback control using the thermistor 7.

With the above-described structure, before a copying operation is started, the heating roller 2 is heated until the surface temperature thereof reaches the predetermined value by the feedback control. When the surface temperature of the heating roller 2 reaches the predetermined value, the copying operation is started. When transfer paper passes a fixing point, which is the contact portion (nip portion) of the heating roller 2 and the pressing roller 3, a developer on the transfer paper becomes melted and pressed to the sheet and is fixed to the sheet.

Figure 2:
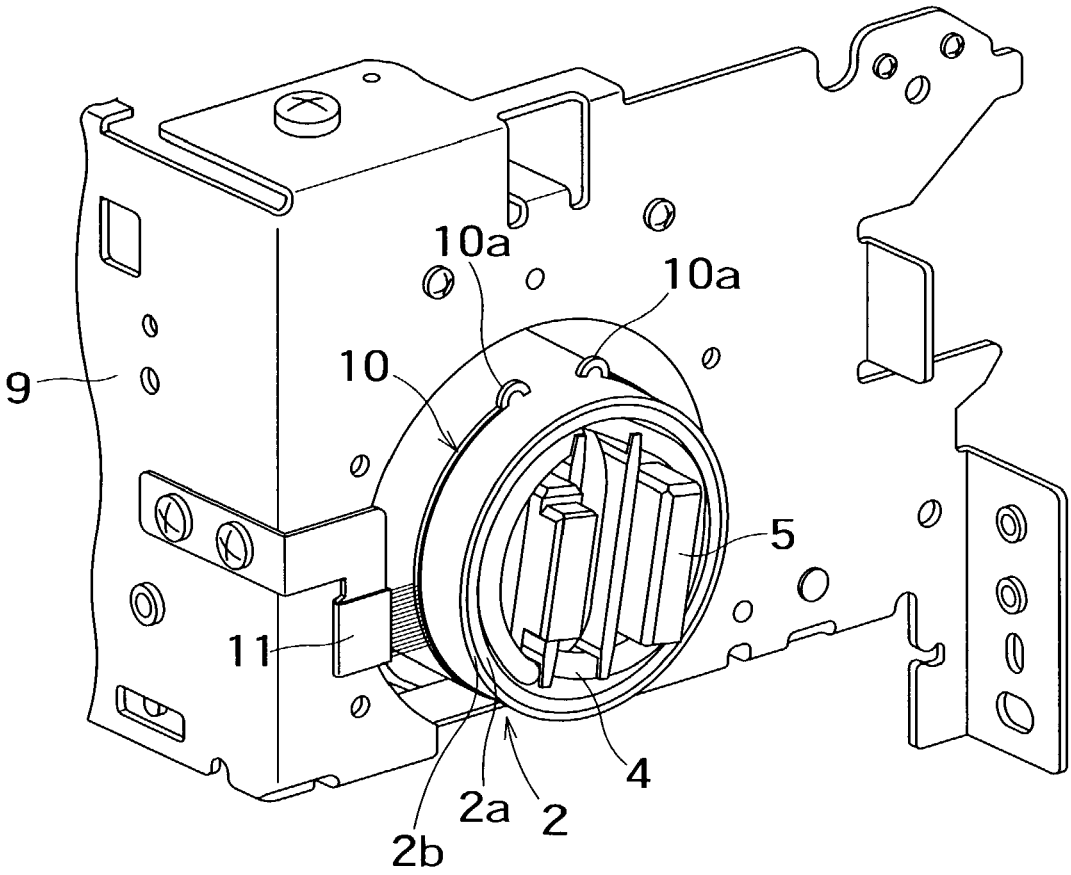
FIG. 2 is a perspective view showing the structure of an edge portion of a heating roller and a metal frame supporting the edge portion in the induction heating fixing device shown in FIG. 1.

FIG. 2 is a schematic perspective view showing the specific structure of the edge portion of the heating roller 2 and its vicinity in the induction heating fixing device 1. The heating roller 2 is grounded so as to eliminate electricity, which will be described below with reference to FIGS. 2 and 3.

Figure 3:
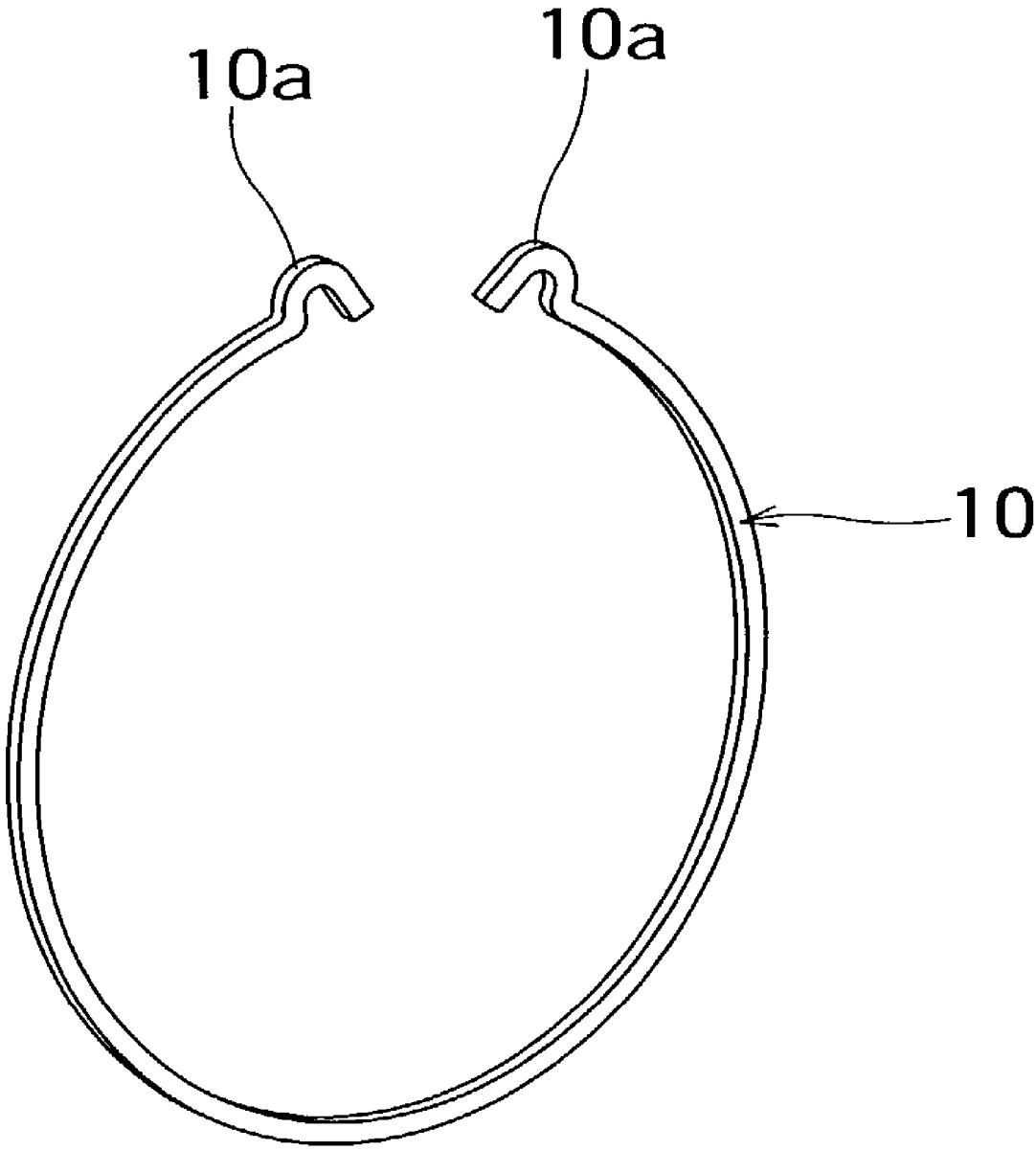
FIG. 3 is a perspective view showing a conductive ring engaged with the heating roller shown in FIG. 2.

As shown in FIG. 2, the heating roller 2 is rotatably supported by a grounded metal frame 9 by the use of a bearing (not shown). As shown in FIG. 2, a conductive ring (auxiliary member) 10 shown in FIG. 3 is engaged with the edge portion of the heating roller 2. Electrically, the conductive ring 10 functions to ground the conductive roller 2*a*, and mechanically, it prevents the heating roller 2 from disengaging from the bearing. FIG. 3 is an enlarged perspective view specifically showing the conductive ring 10. As shown in FIG. 3, the conductive ring 10 is substantially in the shape of circle, and both the edge portions thereof are shaped into protruding portions 10*a*.

As shown in FIG. 2, when the conductive ring 10 is attached to the heating roller 2, the protruding portions 10*a* of the conductive ring 10 dig into the releasing layer 2*b* so as to contact the conductive roller 2*a*. Further, the conductive ring 10 is rubbed and contacted by a brush 11 attached to the grounded metal frame 9. Thus, the conductive roller 2*a* is electrically connected with the metal frame 9 via the releasing layer 2*b*. That is, the electricity stored in the heating roller 2 flows through the conductive ring 10, the brush 11, and the metal frame 9. Accordingly, the electricity of the heating roller 2 is eliminated.

Thus, according to this embodiment, the conductive ring 10 is engaged with the heating roller 2 such that the protruding portions 10*a* of the conductive ring 10 dig into the releasing layer 2*b* to contact the conductive roller 2*a* of the heating roller 2. Accordingly, the conductive roller 2*a* of the heating roller 2 can be grounded via the conductive ring 10. Furthermore, in this way, it is possible to inhibit the conductive roller 2*a* of the heating roller 2 from emitting electric wave noises of the induction heating coil 4 as electromagnetic waves.

Figure 4:
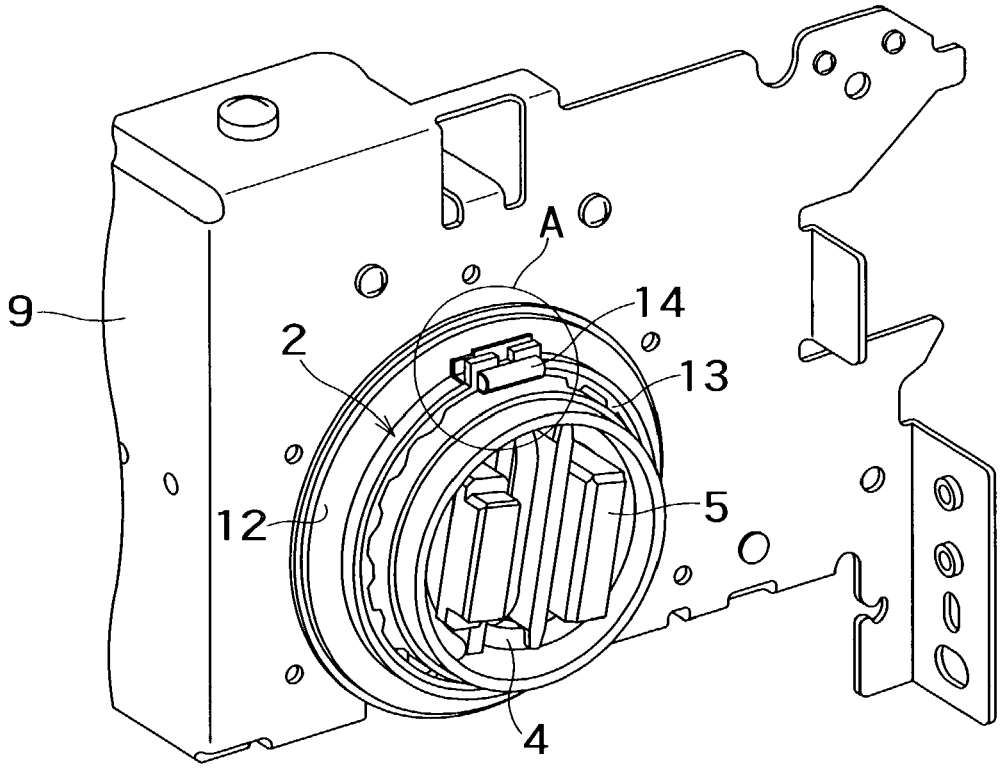
FIGS. 4(*a*) and 4(*b*) are a perspective view and a fragmentary enlarged view of an edge portion of a heating roller of an induction heating fixing device according to another embodiment of the present invention.
Figure 4:
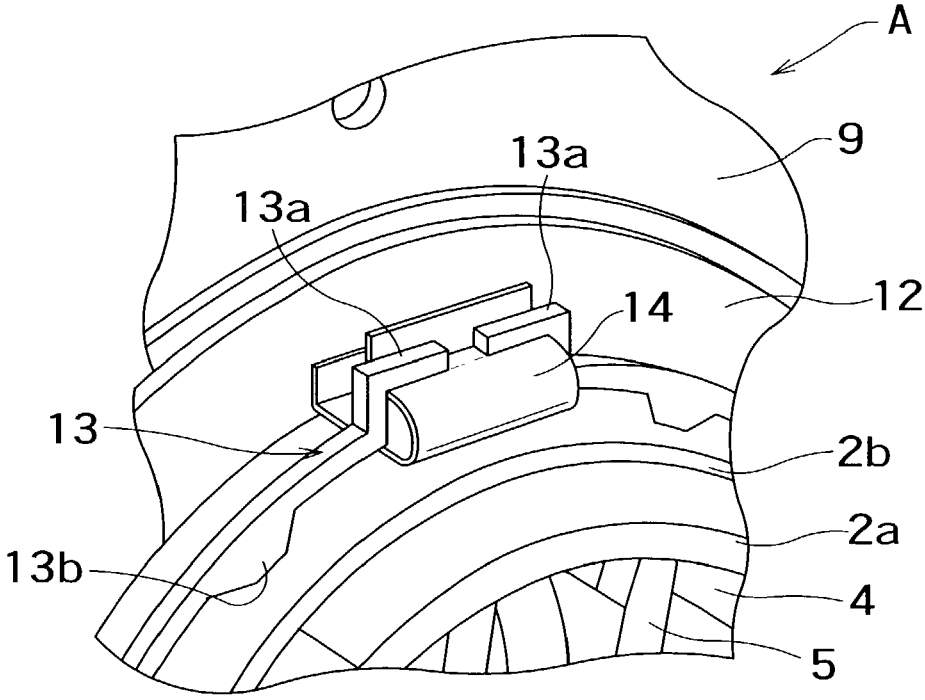

FIG. 4(*a*) shows another embodiment of the present invention, in which a conductive ring in a different shape is used to ground the conductive roller 2*a* of the heating roller 2. This will be described below with reference to FIGS. 4 and 5.

Figure 5:
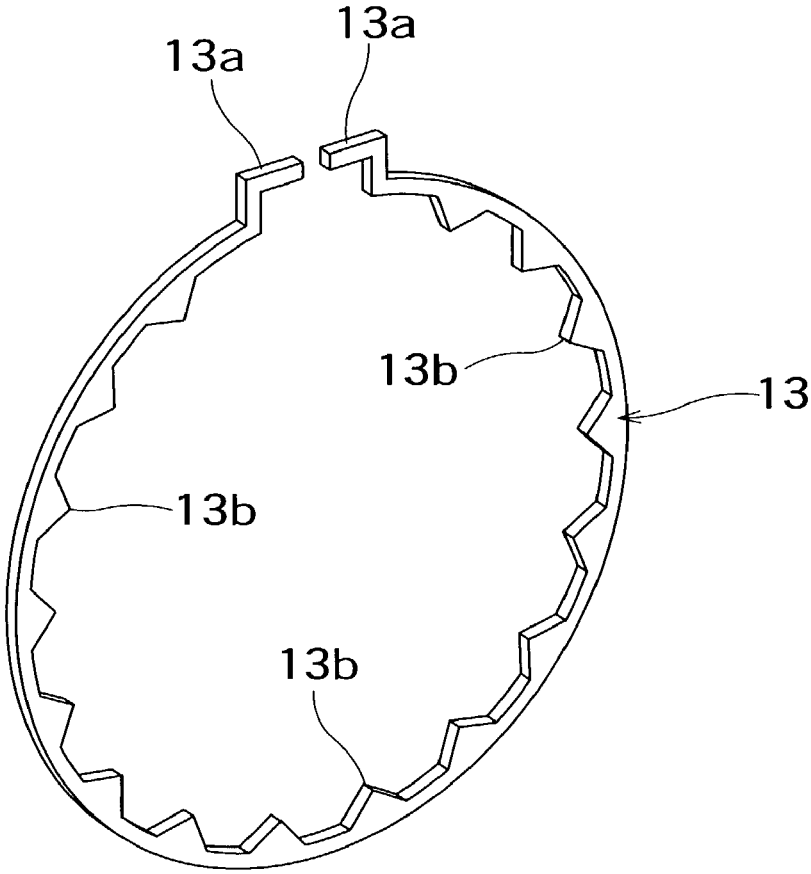
FIGS. 5(*a*) and 5(*b*) are perspective views of a conductive ring engaged with the heating roller shown in FIG. 4(*a*), and a conductive spring.
Figure 5:
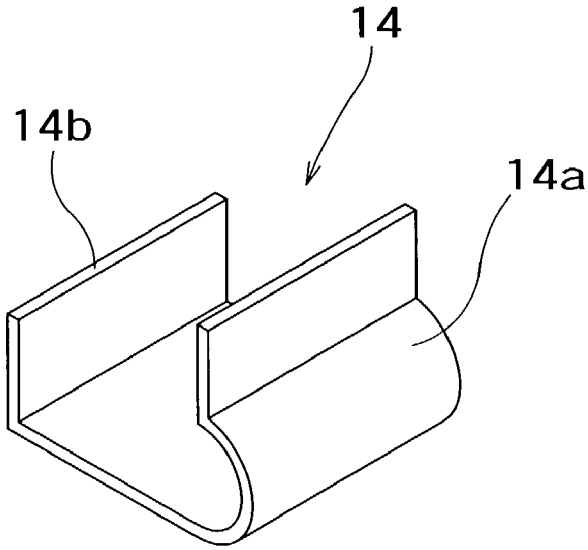

FIG. 5(*a*) is an enlarged perspective view specifically showing a conductive ring (auxiliary member) 13 used in this embodiment. The conductive ring 13 is substantially in the shape of a circle, and has L-shaped stopper members 13*a* at the edge portions thereof, which electrically serve as terminals. Further, the conductive ring 13 has a plurality of equally-spaced, pointed protruding portions 13*b* on its inner surface.

As shown in FIG. 4(*a*), the conductive ring 13 is engaged with the heating roller 2. That is, the conductive ring 13 is opened to be engaged with the heating roller 2, and then, using the elastic spring force of the conductive ring 13, a step portion 14*a* of a conductive spring 14 shown in FIG. 5(*b*) is integrally fixed between the stopper portions 13*a*, 13*a* of the conductive ring 13. A contact wall 14*b* tends to incline to the left side in FIG. 5(*b*), resulting in that it electrically contacts a bearing 12, as shown in FIG. 4(*b*).

FIG. 5(*b*) is an enlarged view of the conductive spring 14 shown in the portion A of FIG. 4(*a*), which is specifically indicated. As shown in FIG. 5(*b*), the conductive spring 14 is constituted as a flat spring. As can be understood from FIG. 5(*b*), one end of the conductive spring 14 is bent so as to contact the bearing 12 with pressure. The other end of the conductive spring 14 is bent in a U-shape, of which the edge is further bent so as to be engaged with the edge portions 13*a* of the conductive ring 13. Thus, the conductive roller 2*a* is electrically connected to the metal frame 9 via the releasing layer 2*b*. That is, the electricity stored in the conductive roller 2*a* of the heating roller 2 flows through the conductive ring 13, the conductive spring 14, the bearing 12, and the metal frame 9. Accordingly, the electricity of the heating roller 2 is eliminated.

Thus, according to this embodiment, the conductive ring 13 is engaged with the heating roller 2 such that the protruding portions 13*b* of the conductive ring 13 dig into the releasing layer 2*b* to contact the conductive roller 2*a* of the heating roller 2. Accordingly, the heating roller 2 can be grounded via the conductive ring 13. Furthermore, in this way, it is possible to inhibit the heating roller 2 from emitting electric wave noises from the induction heating coil 4.

As described above, according to the present invention, in an induction heating type fixing device including a fixing roller formed by coating the outer surface of a conductive roller with an adhesion preventing layer, a circle-shaped conductive member is engaged with the fixing roller such that a portion of the circle-shaped conductive member digs into the adhesion preventing layer to contact the conductive roller. Accordingly, the electricity stored in the fixing roller is eliminated via the circle-shaped conductive member, and it is possible to surely ground the fixing roller.

What is claimed is:

1. An image forming apparatus comprising:

a pressing roller for pressing a sheet of paper on which an unfixed developer is prepared;

a fixing roller including a conductive roller and a releasing layer coating the conductive roller, the releasing layer facilitating removal of adhered developer, said fixing roller rotating with the sheet of paper being sandwiched between said fixing roller and said pressing roller to fix the developer to the sheet of paper with heat;

an auxiliary member for eliminating electricity being a substantial circle member, engaged with the outer surface of said fixing roller, and having at least one protruding portion penetrating the releasing layer to contact and electrically connect to the surface of the conductive roller; and a member for eliminating electricity set at ground potential for electrically contact said auxiliary member to the ground potential.

2. The image forming apparatus according to claim 1, wherein the protruding portion of said auxiliary member is formed by inwardly bending one end of the circle member, and wherein at the time said auxiliary member is attached to said fixing roller, the protruding portion digs into and penetrates the releasing layer to electrically contact said conductive roller.

3. The image forming apparatus according to claim 2, wherein there are two of the protruding portions, formed by inwardly bending both ends of the circle member.

4. The image forming apparatus according to claim 2, wherein the outer circumference of said auxiliary member is larger than the outer circumference of said fixing roller when the auxiliary member is attached to said fixing roller, and wherein when said fixing roller is supported by a bearing, said auxiliary member functions as a stopper for limiting the movement of said fixing roller in a longitudinal direction of the roller.

5. The image forming apparatus according to claim 2, wherein said auxiliary member is formed of an elastic material having an inner diameter smaller than an outer diameter of said fixing roller, and when said auxiliary member is attached to said fixing roller, said auxiliary member closely contacts said fixing roller by an elastic spring force.

6. The image forming apparatus according to claim 2, wherein said fixing roller includes a heat source therein, which is an induction heating coil for performing induction heating of said conductive roller when being supplied with a high-frequency current.

7. The image forming apparatus according to claim 2, wherein said conductive roller is formed of a metal or a composite material, and wherein said releasing layer is formed of a resin containing fluorine.

8. The image forming apparatus according to claim 1, wherein said member is a brush for eliminating electricity connected to ground potential, and a brush member of the brush electrically contacts said auxiliary member, which is being rotated.

9. The image forming apparatus according to claim 8, wherein said member is fixed to a portion of a metal frame connected to ground potential.

10. The image forming apparatus according to claim 1, wherein the protruding portion of said auxiliary member protrudes inwardly from the inner circumference of the circle member, and wherein the protruding portion digs into and penetrates said releasing layer to electrically contact said conductive roller when said auxiliary member is attached to said fixing roller.

11. The image forming apparatus according to claim 10, wherein the outer circumference of said auxiliary member is larger than the outer circumference of said fixing roller when the auxiliary member is attached to said fixing roller, and wherein when said fixing roller is supported by a bearing, said auxiliary member functions as a stopper for limiting the movement of said fixing roller in a longitudinal direction of the roller.

12. The image forming apparatus according to claim 10, wherein said member is a brush for eliminating electricity connected to ground potential, and a brush member of the brush electrically contacts said auxiliary member, which is being rotated.

13. The image forming apparatus according to claim 12, wherein said member is fixed to a portion of a metal frame connected to ground potential.

14. The image forming apparatus according to claim 10, wherein said auxiliary member is formed of an elastic material having an inner diameter smaller than an outer diameter of said fixing roller, and when said auxiliary member is attached to said fixing roller, said auxiliary member closely contacts said fixing roller by an elastic spring force.

15. The image forming apparatus according to claim 10, wherein said fixing roller includes a heat source therein, which is an induction heating coil for performing induction heating of said conductive roller when being supplied with a high-frequency current.

16. The image forming apparatus according to claim 10, wherein said conductive roller is formed of a metal or a composite material, and wherein said releasing layer is formed of a resin containing fluorine.

* * * * *